US011952884B2

(12) United States Patent
Rolfsvåg et al.

(10) Patent No.: US 11,952,884 B2
(45) Date of Patent: Apr. 9, 2024

(54) CONTINUOUS WATER PRESSURE MEASUREMENT IN A HYDROCARBON RESERVOIR

(71) Applicant: HYDROPHILIC AS, Tananger (NO)

(72) Inventors: Trond Arne Rolfsvåg, Tananger (NO); Gilberto Toffolo, Røyneberg (NO)

(73) Assignee: HYDROPHILIC AS, Tananger (NO)

( * ) Notice: Subject to any disclaimer, the term of this patent is extended or adjusted under 35 U.S.C. 154(b) by 215 days.

(21) Appl. No.: 17/595,527

(22) PCT Filed: May 13, 2020

(86) PCT No.: PCT/NO2020/050122

§ 371 (c)(1),
(2) Date: Nov. 18, 2021

(87) PCT Pub. No.: WO2020/236004

PCT Pub. Date: Nov. 26, 2020

(65) Prior Publication Data

US 2022/0213783 A1 Jul. 7, 2022

(30) Foreign Application Priority Data

May 20, 2019 (NO) ..... 20190627

(51) Int. Cl.
*E21B 47/06* (2012.01)
*E21B 23/06* (2006.01)
(Continued)

(52) U.S. Cl.
CPC ..... *E21B 47/06* (2013.01); *E21B 23/06* (2013.01); *E21B 37/06* (2013.01); *E21B 47/12* (2013.01)

(58) Field of Classification Search
CPC ..... E21B 47/06; E21B 23/06; E21B 37/06; E21B 47/12
See application file for complete search history.

(56) References Cited

U.S. PATENT DOCUMENTS 4,282,750 A * 8/1981 Prats ..... E21B 47/06 73/152.39
5,233,866 A 8/1993 Desbrandes
(Continued)

FOREIGN PATENT DOCUMENTS

EP 1200709 B1 9/2003

OTHER PUBLICATIONS

International Search Report issued for International Patent Application No. PCT/NO2020/050122, dated Sep. 13, 2020 in 2 pages.
(Continued)

*Primary Examiner* — Crystal J. Lee
(74) *Attorney, Agent, or Firm* — Knobbe, Martens, Olson & Bear, LLP

(57) ABSTRACT

A device for continuous water pressure measurement in a hydrocarbon reservoir comprising a pressure sensor, a hydrophilic membrane positioned between a reservoir formation and the pressure sensor, the hydrophilic membrane having a surface area A, and a biasing device pushing the hydrophilic membrane against the reservoir formation with a force equal to, or larger than, the pressure difference between a hydrocarbon phase Po in the reservoir and the water (Po-Pw) multiplied with the probe membrane contact area. Methods of installing the device in a hydrocarbon reservoir are also disclosed.

16 Claims, 5 Drawing Sheets

(51) Int. Cl.
*E21B 37/06* (2006.01)
*E21B 47/12* (2012.01)

(56) References Cited

U.S. PATENT DOCUMENTS

| | | | | |
|---|---|---|---|---|
| 6,745,839 | B1 * | 6/2004 | Simpson | E21B 37/04 166/173 |
| 2005/0109098 | A1 | 5/2005 | Difoggio | |
| 2008/0308271 | A1 | 12/2008 | Chouzenoux et al. | |
| 2011/0284216 | A1 * | 11/2011 | Addis | E21B 47/01 166/250.01 |
| 2011/0315377 | A1 | 12/2011 | Rioufol | |
| 2012/0168153 | A1 | 7/2012 | Joseph et al. | |
| 2015/0047979 | A1 | 2/2015 | Mahavadi et al. | |
| 2016/0201451 | A1 | 7/2016 | Godager | |

OTHER PUBLICATIONS

Norwegian Search Report issue for Norwegian Patent Application No. 20190627, dated Nov. 29, 2019 in 2 pages.
European Search Report for EP Application No. 20808846.8 dated Jan. 9, 2023.

* cited by examiner

CONTINUOUS WATER PRESSURE MEASUREMENT IN A HYDROCARBON RESERVOIR

CROSS-REFERENCE TO RELATED APPLICATIONS

This application is the U.S. National Phase under 35. U.S.C. § 371 of International Application PCT/NO2020/050122, filed May 13, 2020, which claims priority to Norwegian Patent Application No. 20190627, filed May 20, 2019. The disclosures of the above-described applications are hereby incorporated by reference in their entirety.

TECHNICAL FIELD OF THE INVENTION

The invention concerns a device for continuous water pressure measurement in a hydrocarbon reservoir, and related methods.

BACKGROUND OF THE INVENTION

Several technologies exist for defining the hydrocarbon-water contact during the drilling of a new well penetrating the contact, mostly based on electrical logs recorded while drilling or later with dedicated wire line logging tools. There are also logging tools able to detect the position of the water table at a certain distance from the well during the drilling process with deep resistivity investigations, however both these solutions give the position of the contact before the hydrocarbon production begins and the water-hydrocarbon contact gradually progresses towards the wellbore.

There are also solutions with permanent installations that can detect with a certain degree of approximation the movement of the water with Cross Hole Electro Magnetic Tomography. In this case a number of electrodes are placed along at least two production or monitoring wells and investigations are performed at regular intervals. With two monitoring wells the investigation is performed along the plane containing the two wells, with three or more wells it is possible to evaluate the movement of the water inside the volume containing the wells. Some disadvantage of these solution are the complexity, the cost and the need of having at least two wells.

Some recent solutions to detect the movement are based on Multifrequency Electro Magnetic Investigations from a relatively high number of electrodes placed along the wellbore, typically horizontal, that are part of the completion. With several wells placed parallel to each other it is possible to map the movement of the water over a large area. This solution is also relatively complex and expensive and has also the need of having the wells placed along predefined and possibly parallel patterns, thing possible in specific situations only.

4D seismic investigations are also known, and could give important information on the position of the water hydrocarbon contact, however the efficiency of the investigation is good only for high density contrast as for example in a gas field with strong water drive. Moreover permanent installations are expensive and, given their high cost, also recording on-demand could be performed only with long intervals.

The prior art includes Norwegian patent number 342792 ("A probe arrangement for pressure measurement of a water phase inside a hydrocarbon reservoir"), which discloses a device and method to measure the water pressure inside a hydrocarbon reservoir by drilling past a disturbed and/or polluted zone of the formation close to the well.

The prior art also includes US 2011/0284216 A1, which discloses a method for producing hydrocarbon fluids through a well having a well casing string with a casing section which is surrounded by an annular space. The annular space comprises a sensor assembly for measuring electromagnetic and/or other physical properties of solid and fluid materials within the annular space, in an underground formation surrounding the annular space and/or within the interior of the section of the casing string. The sensor assembly is mounted on a body of swellable material, such as a swellable rubber or other elastomeric material, which is secured to the outer surface of said casing section and presses the sensor assembly against the inner surface of the surrounding underground formation after the casing string has been lowered into the wellbore.

The prior art also includes US 2011/0315377 A1, which discloses a downhole tool including a tubing configured for deployment in a wellbore and a measurement unit disposed on an outside of the tubing. The measurement unit comprises a detector embedded in a swellable material.

SUMMARY OF THE INVENTION

The invention is set forth and characterized in the main claim, while the dependent claims describe other characteristics of the invention.

It is thus provided a device for continuous water pressure measurement in a hydrocarbon reservoir, comprising a pressure sensor; a hydrophilic membrane positioned between a reservoir formation and the pressure sensor, the hydrophilic membrane having a surface area; and a biasing device for pushing the hydrophilic membrane against the reservoir formation with a force which is equal to or greater than the pressure difference between a hydrocarbon phase and the water phase multiplied with the surface area of the contact surface of the hydrophilic membrane.

The device may further comprise a cleaning device adapted to clean the surface of the reservoir formation prior to pushing the hydrophilic membrane against the reservoir formation. The cleaning device may be a mechanical cleaning device, such as brushes, jets adapted to jetting a fluid against the wall of the well, or a device adapted to clean by inducing vibration- and/or pressure pulses against the wall of the well. The cleaning device may be adapted to inject a fluid that cleans pores and removes adsorbed chemicals, such as methanol, toluene, water-based, acids, or a combination of them. The biasing device may be a spring. The biasing device may be a swellable elastomer. The biasing device may be a metallic liner.

In an embodiment, the hydrophilic membrane has a continuous surface against the reservoir formation. The hydrophilic membrane may consist of a plurality of separate surfaces against the reservoir formation.

In an embodiment, the device further comprises a transmitter device transferring the water pressure measurements to the surface. The transmitter device may transfer the water pressure measurements continuously.

In an embodiment, the device further comprises a reservoir for a hydrophilic liquid.

In is also provided a method of installing the device according to the invention in a hydrocarbon reservoir, comprising:

a) expanding the biasing device until the biasing device is in contact with the formation;

b) expanding the biasing device until the hydrophilic membrane is pushed against the reservoir formation with a force equal to or greater than the pressure difference between a hydrocarbon phase and the water phase multiplied with the surface area of the contact surface of the hydrophilic membrane;

wherein hydrophilic fluid from the reservoir is injected through the hydrophilic membrane and into the formation to overcome the invaded zone, either before or after step b).

It is also provided a method of installing the device according to the invention in a hydrocarbon reservoir, comprising providing packers proximate to the device, injecting hydrophilic fluid to the hydrophilic membrane;

expanding the biasing device until the packers is in contact with the formation;

expanding the biasing device until the hydrophilic membrane is pushed against the reservoir formation with a force equal to, or larger than, the pressure difference between a hydrocarbon phase in the reservoir and the water multiplied with the probe membrane contact area, such that the hydrophilic fluid is forced out from the membrane into the formation to overcome the invaded zone.

Relating to the development of hydrocarbon reservoirs, the main advantages of the proposed solution are the simplicity, the higher precision of the hydrocarbon contact determination, and the lower cost of installation. The combination of these characteristics will make this technology applicable in every well with a single tool (and even several tools) applied per well. The combination of the information gathered in different wells will make it possible to understand how water is moving inside the reservoir. Knowing how water moves will help determine where to place infill wells in order to recover the remaining hydrocarbon more efficiently.

The present invention disclose a system and a method to measure the water pressure inside a hydrocarbon reservoir without drilling past the disturbed and/or polluted region near a wellbore.

BRIEF DESCRIPTION OF THE DRAWINGS

The above and other characteristics of the invention will become clear from the following description of embodiments of the invention, given as non-restrictive examples, with reference to the attached schematic drawings, wherein.

DETAILED DESCRIPTION OF EMBODIMENTS OF THE INVENTION

Figure 1:
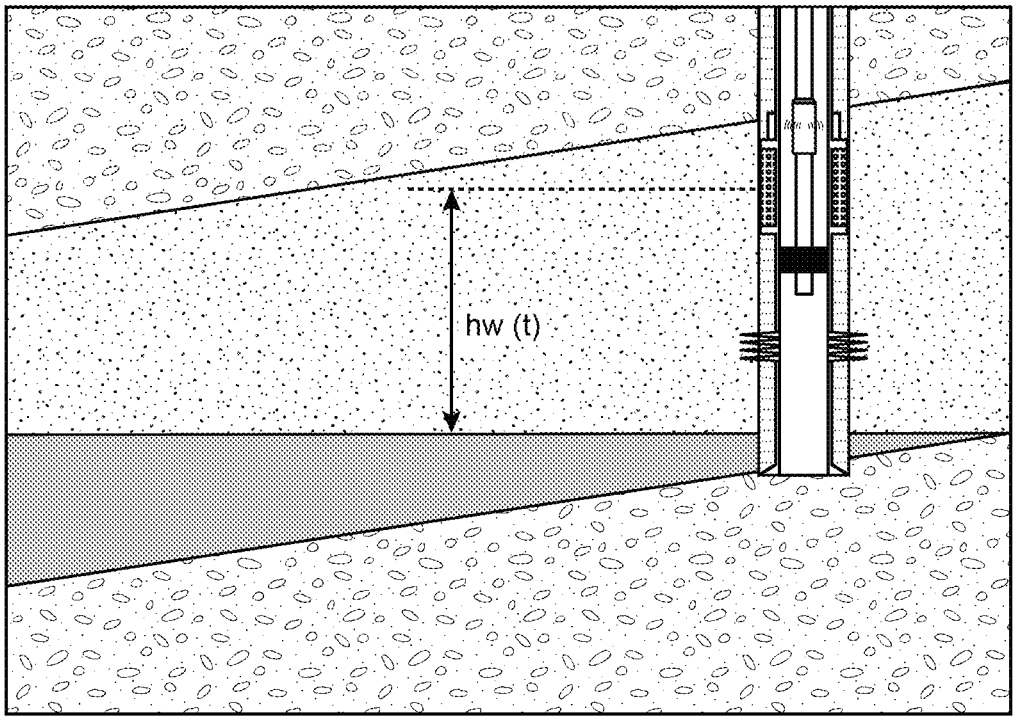
FIG. 1 illustrates a first exemplary embodiment of the invention.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

In the following description, various examples and embodiments of the invention are set forth in order to provide the skilled person with a more thorough understanding of the invention. The specific details described in the context of the various embodiments and with reference to the attached drawings are not intended to be construed as limitations. Rather, the scope of the invention is defined in the appended claims.

An object of the invention is the continuous measurement of water pressure inside the formation regardless of the pressure of the hydrocarbon phase, during the whole production life of a hydrocarbon field.

The difference between the water pressure and the pressure of the hydrocarbon will help defining the position of the hydrocarbon-water contact that is moving during the field life. Monitoring the evolution of this contact in different parts of the reservoirs will help understanding how the formation water or the injected water moves in the reservoir and will help understanding the distribution of the unproduced hydrocarbon, finally suggesting the best strategy to maximise the recoverable hydrocarbon. FIG. 1 illustrates a general concept of measuring the distance, $h_w(t)$, between the hydrocarbon/water contact and the producing interval in a generic vertical well at a time t. The possibility of monitoring the movement of the oil/water contact during the production life of a well will give several advantages:

Well Production Forecast

This will give the possibility to compare the actual production with the expected behaviour during its whole life. In other words, while it is relatively easy to compare the actual production with the expected flowrate at any single time, there is currently no system able to evaluate whether a well is on its way to meet the expected final cumulative recovery or not. This becomes clear only when the formation water or injected water meets the well. There are several reasons why the final recovery factor might be different from initial simulation, higher or lower, due to the complexity of the reservoir or unexpected communication between layers or different wells at reservoir level. This might be typical in naturally fractured reservoirs.

Many wells are considered a success due to the initial flowrate; however what matters most is that the flowrate could be sustained continuously through all its expected life. The information is extremely important when decisions have to be taken in order to allocate new infill wells or to evaluate the end of the production life of a well or a field.

While from the analysis of the distance of the oil-water contact (OWC) vs. time it might be possible to evaluate, the expected time for the water to reach the well and as a consequence the expected final cumulative, from the analysis of the derivative of the same function it could be possible to evaluate for example if water coning is in progress or if water is approaching through a channel rather than through a path with expected geometry.

Well Production Optimization

Once the behaviour of the OWC versus time is monitored, considering the flowrate a variable, it could be possible to maximise the production versus time.

Figure 2:
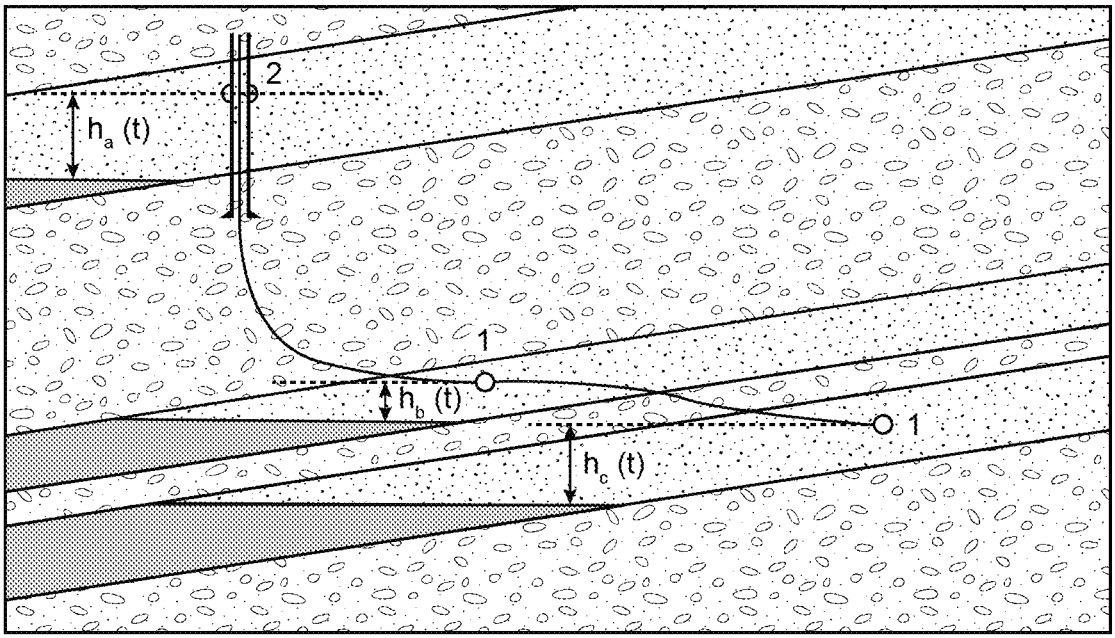
FIG. 2 illustrates a second exemplary embodiment of the invention.

FIG. 2 illustrates an embodiment where more than one tool in the same well detects the movement of the hydrocarbon-water contacts in different producing layers. In this case a tool 1 could be placed both in the horizontal reservoir section, detecting the behaviour of the contacts during the production of the same well in one or more layers $h_b(t)$, $h_c(t)$. However, a tool 2 could also be placed outside the production casing and record the pressure behaviour, $h_a(t)$, of layers not directly connected to the productive zones of the same well.

Figure 3:
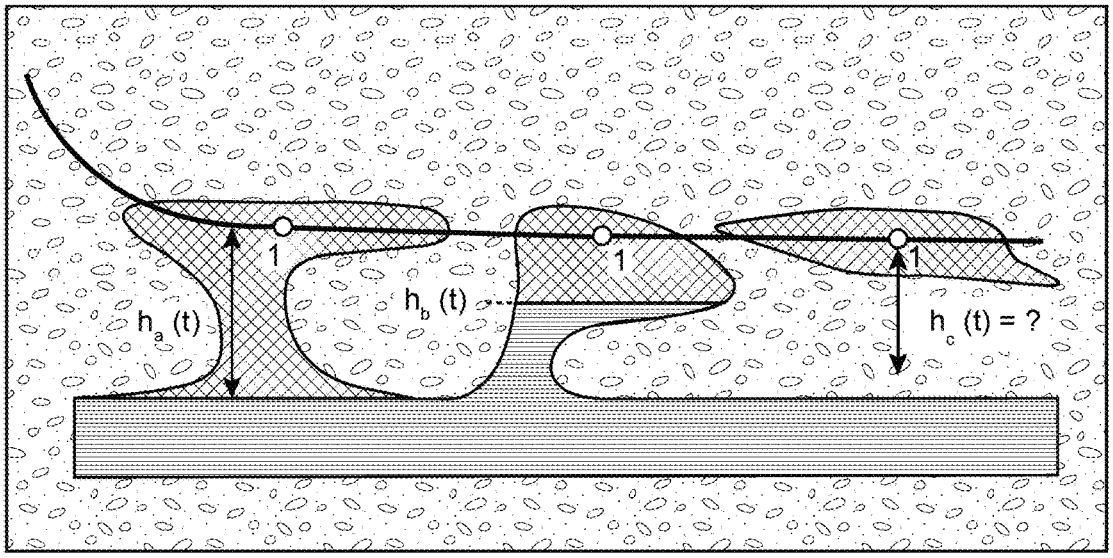
FIG. 3 illustrates a third exemplary embodiment of the invention.

Another exemplary embodiment is illustrated in FIG. 3, and represents a temporary installation during a long production test. Here, three different tools 1 may provide indications of the different distances of three OWC, $h_a(t)$, $h_b(t)$ and $h_c(t)$, and their behaviour during the long production test. In this case an exploration or appraisal well is temporarily completed and put in production for an extended period, for example of few weeks or few months to evaluate its productivity and the behaviour of the reservoir. An important application of the tool would be the determination of the OWC position during the test. This information is quite relevant, in particular when the well crosses independent formations that may or may not be connected. A full understanding of this early stage of production could suggest the best strategy for the development of the field.

Furthermore, an application of the tool could be in the Geosteering phase, when the wells have to be placed in the best position in respect to the water contact. There is technology to give a rough estimate of the water position while drilling, as for example the Deep Resistivity Tool; however, a local measurement of the water pressure could increase the confidence, and sometimes the formation water is beyond the reach of investigation of a deep resistivity tool. A measurement could be done while drilling when also the pressure of the hydrocarbon phase is taken.

The measurement of the water pressure can be described in the following four basic steps:

1. Preparing the formation surface before the tool being set
2. Setting of the tool
3. Establish the hydrophilic continuity between the tool and the formation
4. Acquisition and transmission of data during field life.

Preparing the Formation Surface

Before setting the tool against the formation it might be necessary to remove the panel of mud filtrate that has been depositing at the wall of the well over the permeable formation sections. This could be achieved by a mechanical device placed in front of the tool. Exemplary devices includes brushes or with jetting a fluid against the wall of the well. Vibration/pressure pulses might also remove dirt and expose a clean surface. The same could be run in open position or could be opened before the setting operation and their action could be achieved by rotation or by axial translation or both. In another example, a fluid that cleans the pores and removes adsorbed chemicals can be injected, such as methanol, toluene, water-based, acids, a combination.

Setting the Tool

Setting of the tool is expected to require a strong force to keep the critical parts of the tool in permanent contact with the formation. This can be achieved in several ways as with the expansion of elastic elements, such as pre-compressed springs, by inflating a packer, by forcing a metallic cylinder to expand or by the permanent expansion of an elastomer as a swellable packer. The setting process will be achieved preferably increasing the internal pressure in the tubular or with any other system like axial movements or through the power of a dedicated electrical line. The first part to be set will be an elastomer surrounding a semi-permeable membrane followed by the compression of the same membrane against the rock. The membrane will allow any hydrophilic fluid to enter the formation but will prevent any hydrocarbon fluid from entering the tool itself. The force acting towards the membrane due to the higher hydrocarbon pressure will be counteracted by the force supporting the membrane. The pressure applied to the membrane against the rock will be critical to provide the desired hydrophilic continuity during the life of the field and prevent the hydrocarbon from forming a film that could break the continuous connection with the water in the formation.

Establishing the Hydrophilic Continuity

A continuous communication between the tool and the water in the formation should be provided. To achieve this it is important to overcome a possible section of the formation where the water could have been replaced by filtrate containing surface active components that has altered the surfaces of the rock to become oil wet. The depth of the damaged zone could be evaluated by the analysis of electrical logs. A proposed solution is the injection of a quantity of hydrophilic cleaning solutions to restore the water wet nature of the rock. The hydrophilic cleaning solution could be different in case of different type of formations, for example in case of carbonate or chalk formations it could be a weak acid able to regenerate the water wet nature of the rock surface by partly dissolving the rock. Different fluids could be injected in sequence in order to achieve the best permanent contact and continuity with the formation water. The tool could have a dedicated quantity of fluid stored inside to be injected just after the setting process or could inject part of the fluid present in the well if properly filtrated and with the correct hydrophilic properties. Before entering the formation the hydrophilic fluid will pass through the hydrophilic semi-permeable membrane.

Acquisition and Transmission of Data

Figure 4:
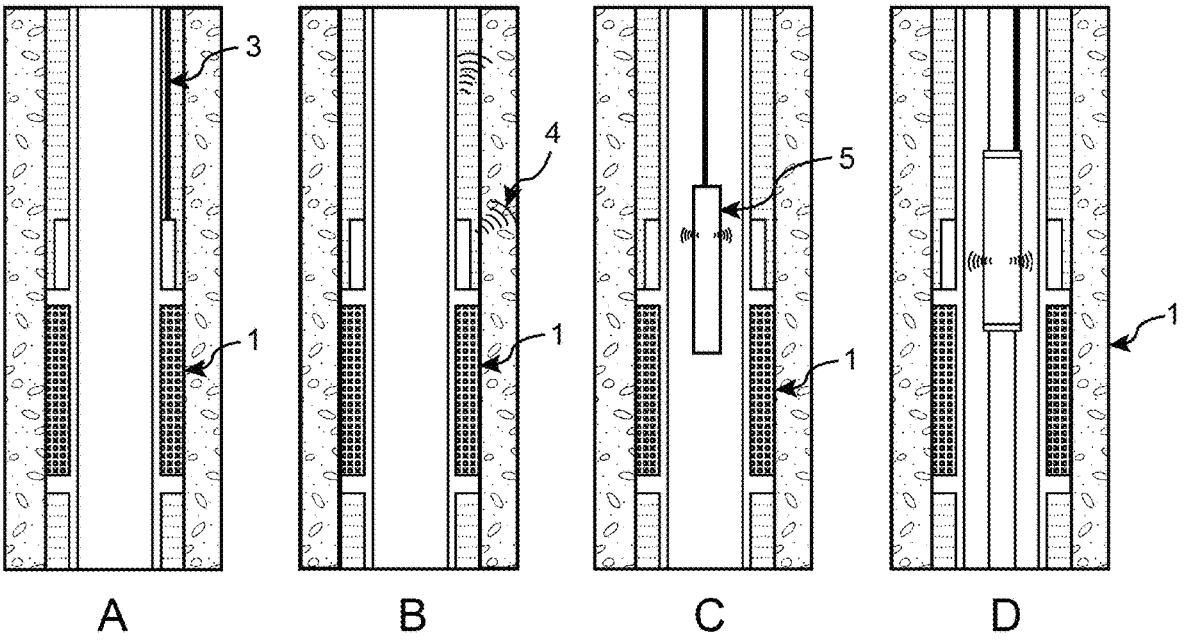
FIG. 4 illustrates fourth to seventh exemplary embodiments of the invention.

Once the hydrophilic continuity is established, the pressure will decrease until it reaches the actual formation water pressure. The tool should preferably be able to measure two different pressures, the pressure of the hydrocarbon and the pressure of the water. Data from the tool should be sent to surface in a continuous form or during specific moments according to the data transmission system. Some exemplary embodiments of data transmission are illustrated in FIG. 4. All the data transfer alternatives are presented for a better understanding of the system represent well known and available art.

FIG. 4 represents four exemplary embodiments, however any other suitable system would be acceptable.

The first exemplary embodiment (FIG. 4A) is the transmission through a dedicated electric line 3 that could be placed along the tubular from the tool 1 to the surface (not shown). This is the best possible solution since data is acquired continuously and power to the tool constantly provided. This solution in some instances could take advantage of the installation of down hole gauges for pressure and temperature that could be already planned to be run downhole. In this case the dedicated line 3 (e.g. in the form of an electric cable or a fibre optic cable) is already part of the completion, the extra cost would be related only to the part of cable along the liner in the reservoir section.

The second exemplary embodiment (FIG. 4B) is a wireless transmission device 4, that transmits either through the steel of the tubulars or through the formation. This system would require a battery power supply. To extend the acquisition time it might be necessary to reduce the sampling and transmission rate, for example to one information per week.

In the third exemplary embodiment (FIG. 4C), the data acquisition would be made with the use of a dedicated run with any device 5 like wireline, coiled tubing, carbon fibre rod or other. In this case a specific device 5 would be temporarily placed in front of the tool and data would be acquired for example through an inductive coupling. In this way all recorded data would be downloaded in every run, saving all the energy needed for the transmission, but the acquisition would be limited in time due to the cost of the operation.

In the fourth exemplary embodiment (FIG. 4D), a solution which refers to behind-casing installations, the data is constantly acquired thanks to a wireless communication between the tool placed around the casing and a transmitter/receiver placed in front of the same and applied in the production tubing. This solution allows to read from any number of tools placed along the casing once the proper receiver/transmitter is placed correctly in front of each one. In this solution the tool does not require batteries since the power can be given wirelessly from the same transmitter.

To measure the pressure of the formation water, it is necessary to create a hydrophilic continuity between the same and the measuring system inside the tool that is the object of the present invention. Loss of this continuity will prevent the capability to measure the water pressure.

Figure 5:
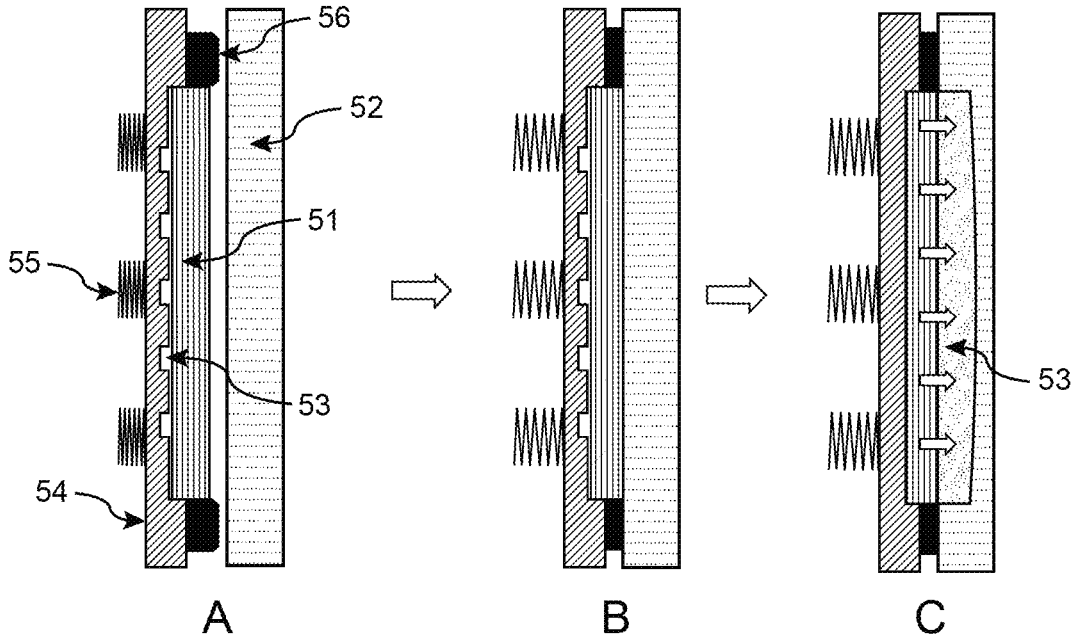
FIG. 5 illustrates an eight exemplary embodiment of the invention.

In its general form, the tool is represented in FIG. 5.

A semi-permeable element 51 is forced against the formation 52 with the force of a series of biasing elements 55, such as springs, that are acting on a support 54 that contains the semi-permeable element 51. A hydrophilic liquid (fluid) 53 is allowed to flow below the semi-permeable element along dedicated channels. A packer 56 is strongly pressed against the formation with the forces of the same biasing elements 55. The semi-permeable element 51 allows the flow of the hydrophilic liquid (fluid) 53 towards the formation 52, but prevents the flow of hydrocarbon in the opposite direction. The force of the biasing elements 55 is greater than the force that the movable hydrocarbon of the formation applies against the semi-permeable membrane, such that the semi-permeable membrane 51 remains in constant contact with the rock of the formation. The force F of the biasing elements is equal to or greater than the pressure difference P between a hydrocarbon phase ($P_o$) and the water phase ($P_w$) multiplied with the area A of the contact surface of the semi-permeable element 51, $F=(P_o-P_w)*A$.

Figure 6:
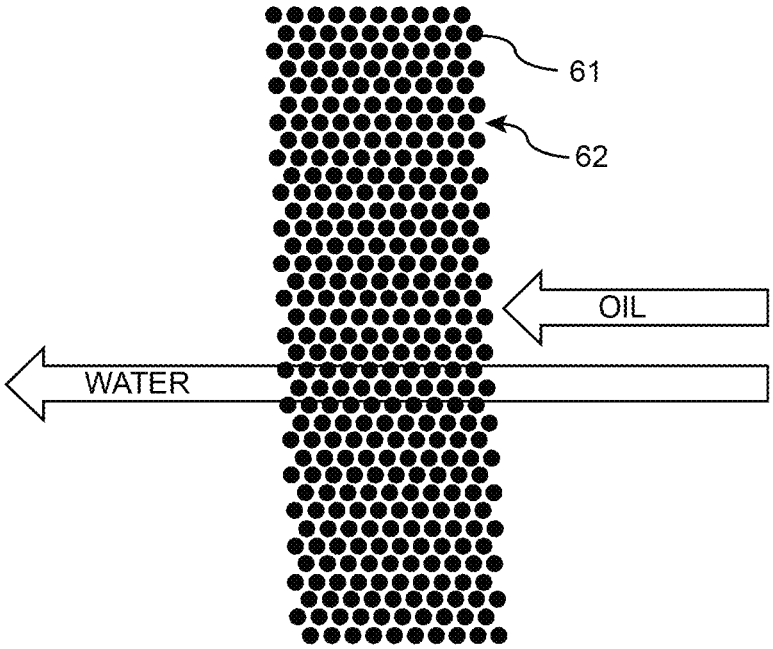
FIG. 6 illustrates an exemplary hydrophilic filter according to the invention.

The semi-permeable element 51 only allows water to pass. There are several different materials that can act as such a membrane, but a common characteristic is that the surface of the membrane is hydrophilic, i.e. attractive to water molecules. We therefore can call it a hydrophilic membrane. An exemplary hydrophilic membrane is illustrated in FIG. 6, having hydrophilic particles 61. The hydrophilic membrane can be made of porous and permeable materials consisting of aluminum oxide, silicon oxide, kaolinite, metal, polymers or many other materials. The hydrophilic membrane can be in the form of a paste (e.g. solid particles mixed with liquid), ceramic material (e.g. fused particles of aluminum oxide), a mesh, a bundle of fibers or a combination of such materials. The materials can be naturally hydrophilic, or they can be made hydrophilic with a surface coating or by a surface treatment. The openings 62 in the hydrophilic membrane must be so small that they prevent the hydrocarbon phase from penetrating the membrane. Since the hydrocarbon phase, unlike water, is not the wetting phase, the interface between the hydrocarbon phase and the water needs to curve sufficiently to pass through the small openings of the hydrophilic membrane. The hydrocarbon entry pressure for a pore in such a membrane must be higher than the pressure difference between the hydrocarbon phase and the water present. The pressure difference between water and the hydrocarbon phase at the top of the hydrocarbon reservoir can be several bars, in some examples exceeding 10 bar.

Given the permeability of the rock of the formation, during the drilling of the well some fluid from the drilling mud could enter the pores of the formation. As the mud (drilling fluid) is a suspension of solid particles in a liquid phase, the solid particles will form a thin layer in front of the formation, while part of the liquid will enter the permeable rock to a depth that cannot be not neglected.

The setting sequence of the tool could be done in three steps. In the first step the tool will expand until the packers will be in contact with the formation. In the second step the force will increase until the packers will be fully set and the semi-permeable membrane will be in complete contact with the formation. In this phase there might be some fluid trapped between the formation and the packers that will be injected and in this case the fluid will enter the formation.

In the third phase some hydrophilic fluid 53 will be injected through the semi-permeable element 51 and will enter the formation to overcome the invaded zone. The amount of fluid required is dependent on the depth of the invasion and the porosity of the formation.

Figure 7:
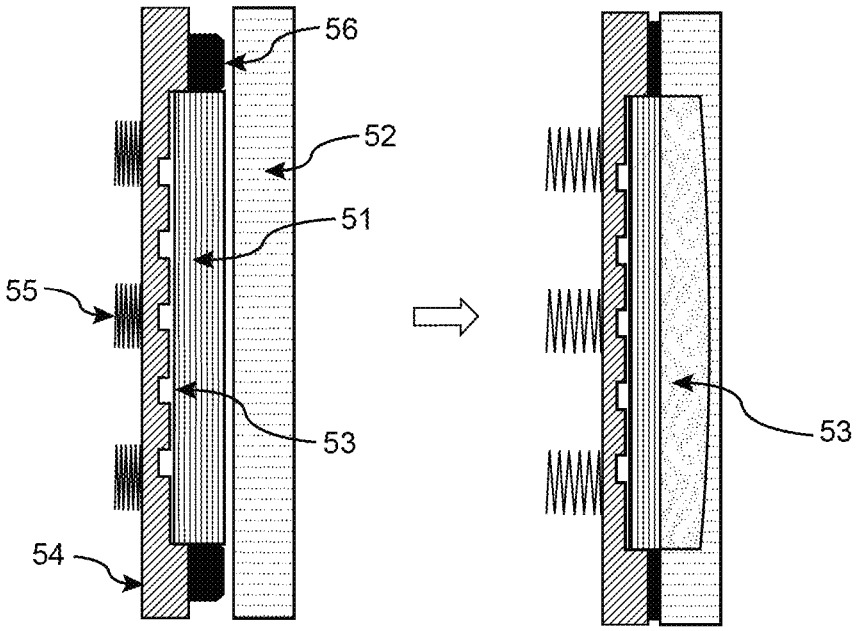
FIG. 7 illustrates a ninth exemplary embodiment of the invention.

Another exemplary embodiment that could simplify the construction is illustrated in FIG. 7. In this embodiment the process is reduced to two steps since the injection is done during the same expansion process. The semi-permeable membrane contains the desired fluid (solvent, acid, water) which is squeezed into the formation during the setting process: Once the setting process is started, the pressure acting on the membrane will force the fluid out from the membrane into the formation. The final thickness of the membrane will be reduced due to ejection of the fluid.

Figure 8:
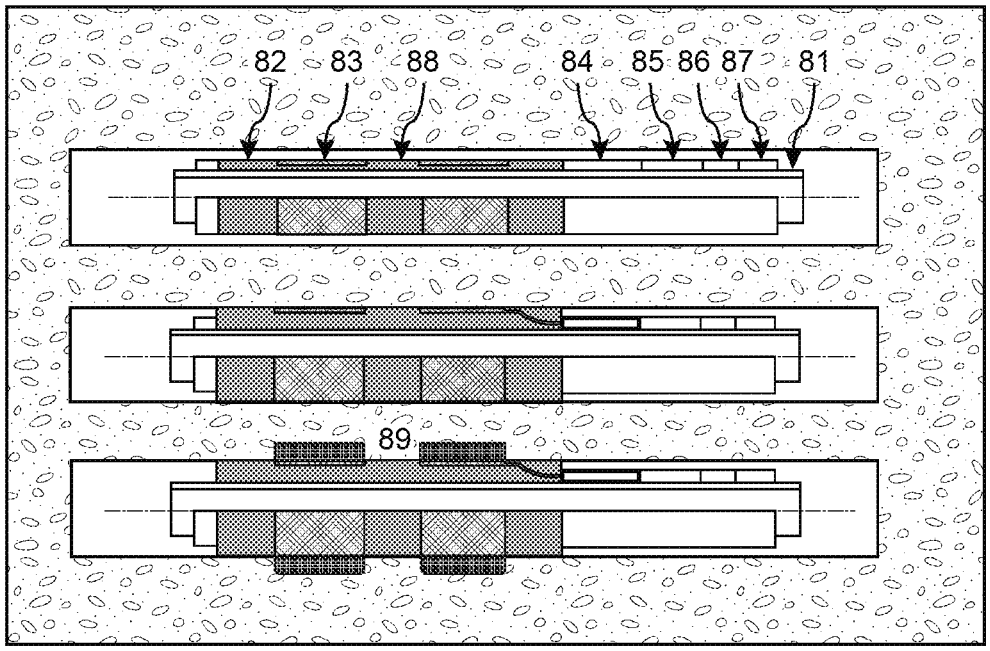
FIG. 8 illustrates a tenth exemplary embodiment of the invention.

FIG. 8 illustrates a two-step process when setting and injection happen simultaneously when using a swell packer. Around a pipe body 81, is assembled a swellable elastomer 82 activated by the fluid present in the well or in the formation. In some sections in the external part of the swell packer are installed semi-permeable elastic membranes 83 in a relatively thin layer. All membranes are connected at their base to a reservoir 84 of hydrophilic fluid through a flexible pipe 88. The packer is normally run and exposed to the fluid in the well or the fluid of the formation after production starts, then slowly and gradually expand the rubber until the whole section is completely filling the well section. The swelling process continues increasing the pressure of the membranes against the formation. During the final part of the expansion or when the process is fully ended some of the hydrophilic fluid contained in the reservoir 84 is injected into the formation 89 through the semi-permeable membrane with the support of a pump unit 85. A measuring device with required electronics 86 is acquiring the pressure of the formation water, that after stabilization equals the pressure of the fluid in the reservoir chamber and the pressure of the movable hydrocarbon in the well. An electronic system 87 provides the transmission capability to send the information at surface.

Alternative system to inject the fluid in this solution could be any different mechanical or hydraulic system normally used to activate tools downhole like releasing weight or increasing the pressure inside the base pipe.

Figure 9:
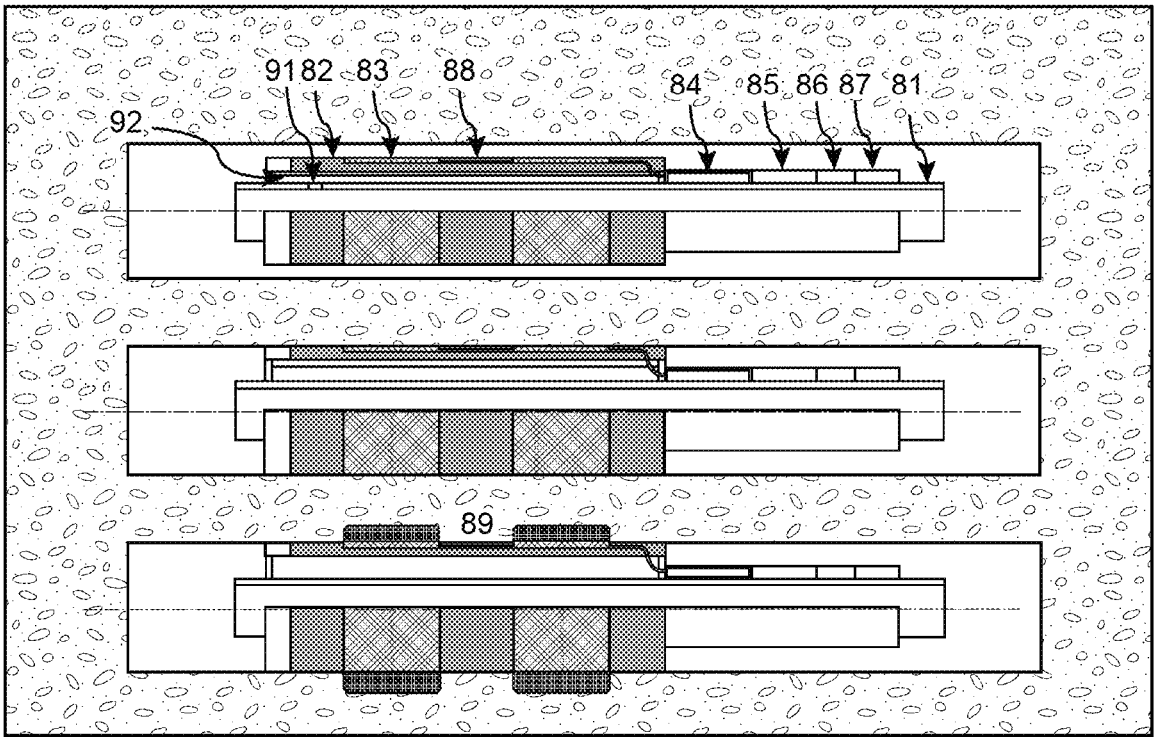
FIG. 9 illustrates an eleventh exemplary embodiment of the invention.

In another exemplary embodiment, illustrated in FIG. 9, differing from the previous in that the expansion is not due to the swelling of an elastomer but rather by the plastic expansion of a metallic liner 92 that presses the elastomer and the hydrophilic membranes against the wall of the formation, i.e. a mechanically expanded packer The expansion could be done in different ways, but in this example is achieved by applying pressure to the internal pipe through a back-pressure valve 91. A dedicated anchoring system, not represented in this drawing, will keep the tubular in the expanded position therefore providing the constant force necessary for the hydrophilic continuity of the system.

Figure 10:
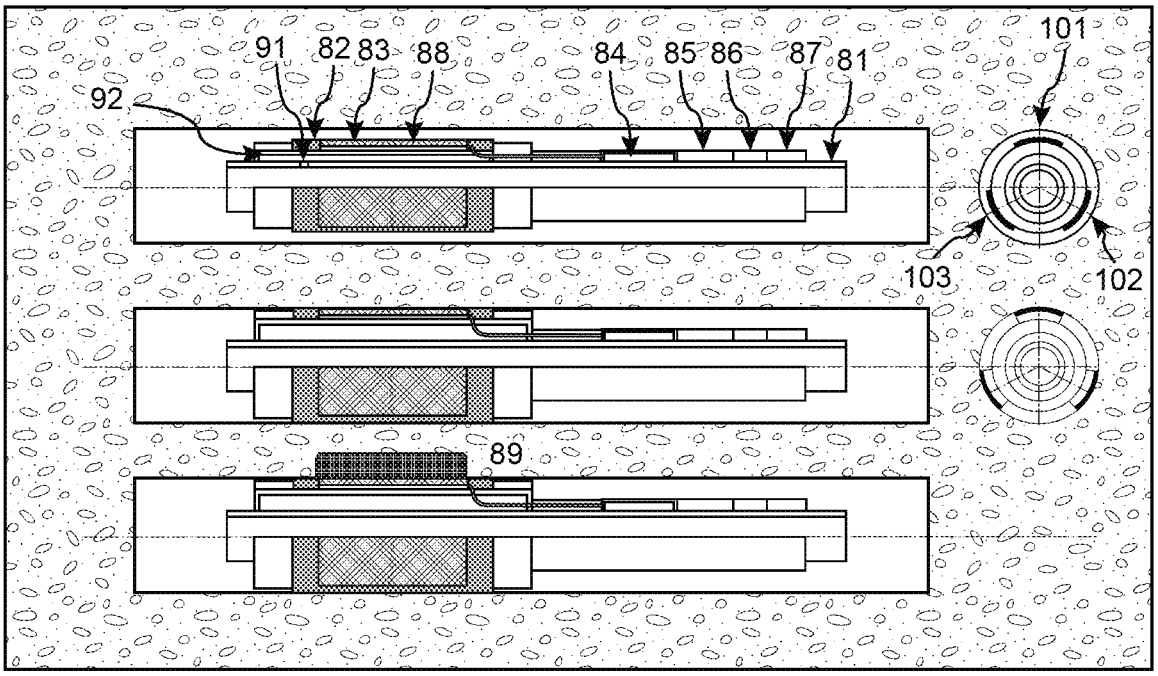
FIG. 10 illustrates a twelfth exemplary embodiment of the invention.

In another exemplary embodiment, illustrated in FIG. 10, differing from the previous in that the contact is not achieved through a cylindrical surface, but rather over independent pads 101, 102, 103. Main reason for this solution is the possibility to install the tool behind casings when the same must be cemented. In this case the tool and the pads are set first, and hydrophilic continuity achieved through the semi-permeable membranes. After the tool is set the cement can be pumped in the annulus. Given that the pads leave enough space for the cement to circulate, the tool is not posing problems to the cementing process. For further reducing the friction losses during the circulation, the three pads could be placed in different sections therefore enlarging the flow area. The expansion in this example is achieved through the injection of fluid from the internal of the base pipe, however also different expansion systems could be envisaged without changing the basic concept of combining a cementing operation with the proper functioning of the tool.

In the exemplary embodiments, various features and details are shown in combination. The fact that several features are described with respect to a particular example should not be construed as implying that those features by necessity have to be included together in all embodiments of the invention. Conversely, features that are described with reference to different embodiments should not be construed as mutually exclusive. As those with skill in the art will readily understand, embodiments that incorporate any subset of features described herein and that are not expressly interdependent have been contemplated by the inventor and are part of the intended disclosure. However, explicit description of all such embodiments would not contribute to the understanding of the principles of the invention, and consequently some permutations of features have been omitted for the sake of simplicity or brevity.

What is claimed is:

1. A device for continuous water pressure measurement in a hydrocarbon reservoir, comprising a pressure sensor;

a reservoir for a hydrophilic fluid;

a hydrophilic membrane which, when the device is installed in the hydrocarbon reservoir, is positioned between a reservoir formation and the pressure sensor, the hydrophilic membrane having a surface area (A), wherein the hydrophilic membrane allows the flow of the hydrophilic liquid towards the formation, but prevents the flow of hydrocarbon in the opposite direction; and a biasing device for pushing the hydrophilic membrane against the reservoir formation with a force (F) which is equal to or greater than the pressure difference (P) between a hydrocarbon phase (Po) and the water phase (Pw) multiplied with the surface area (A) of the contact surface of the hydrophilic membrane wherein the force of the biasing device is greater than the force that the movable hydrocarbon of the formation applies against the membrane, such that the membrane remains in constant contact continuously with the rock of the formation.

2. The device according to claim 1, further comprising a cleaning device adapted to clean the surface of the reservoir formation prior to pushing the hydrophilic membrane against the reservoir formation.

3. The device according to claim 2, wherein the cleaning device is a mechanical cleaning device.

4. The device according to claim 3, wherein the cleaning device is a mechanical cleaning device selected from the group consisting of brushes, jets adapted to jetting a fluid against the wall of the well, and a device adapted to clean by inducing vibration and/or pressure pulses against the wall of the well.

5. The device according to claim 2, wherein the cleaning device is adapted to inject a fluid that cleans pores and removes adsorbed chemicals selected from the group consisting of: methanol, toluene, water-based, acids, and a combination thereof.

6. The device according to claim 5, wherein the chemicals are selected from the group consisting of methanol, toluene, water-based, acids, and a combination thereof.

7. The device according to claim 1, wherein the biasing device is a spring and packers are arranged on opposite sides of the hydrophilic membrane.

8. The device according to claim 1, wherein the packer and the biasing device are comprised by a swellable elastomer.

9. The device according to claim 1, wherein the biasing device is a metallic liner.

10. The device according to claim 1, wherein the hydrophilic membrane has a continuous surface against the reservoir formation.

11. The device according to claim 1, wherein the hydrophilic membrane consist of a plurality of separate surfaces against the reservoir formation.

12. The device according to claim 1, further comprising a transmitter device transferring the water pressure measurements to the surface.

13. The device according to claim 12, wherein the transmitter device is transferring the water pressure measurements continuously.

14. The device according to claim 1, wherein the reservoir for a hydrophilic fluid is arranged between the biasing device and the hydrophilic membrane.

15. A method of installing the device of claim 14 in a hydrocarbon reservoir, comprising:

a) expanding the biasing device until the biasing device is in contact with the formation;

b) expanding the biasing device until the hydrophilic membrane is pushed against the reservoir formation with a force (F) which is equal to or greater than the pressure difference (P) between a hydrocarbon phase (Po) and the water phase (Pw) multiplied with the surface area (A) of the contact surface of the hydrophilic membrane;

whereby the hydrophilic fluid from the reservoir is injected through the hydrophilic membrane and into the formation, either before or after step a) but before step b).

16. A method of installing the device of claim 1 in a hydrocarbon reservoir, comprising providing packers proximate to the device, injecting hydrophilic fluid to the hydrophilic membrane;

expanding the biasing device until the packers is in contact with the formation, expanding the biasing device until the hydrophilic membrane is pushed against the reservoir formation with a force equal to, or larger than, the pressure difference between a hydrocarbon phase Po in the reservoir formation and the water (Po-Pw) multiplied with the surface area (A) of the contact surface of the hydrophilic membrane, such that the hydrophilic fluid is forced out from the membrane into the formation.

* * * * *